US010393155B2

(12) United States Patent
Pauley

(10) Patent No.: US 10,393,155 B2
(45) Date of Patent: Aug. 27, 2019

(54) METHODS AND APPARATUS FOR IMPROVING SOUND WITHIN AN ACOUSTICAL BOUNDARY LAYER

(71) Applicant: Douglas K. Pauley, Downey, CA (US)

(72) Inventor: Douglas K. Pauley, Downey, CA (US)

(73) Assignee: OUT OF THE BOX AUDIO, LLC, Downey, CA (US)

( * ) Notice: Subject to any disclaimer, the term of this patent is extended or adjusted under 35 U.S.C. 154(b) by 0 days.

(21) Appl. No.: 15/999,516

(22) Filed: Aug. 20, 2018

(65) Prior Publication Data

US 2019/0055968 A1 Feb. 21, 2019

Related U.S. Application Data

(60) Provisional application No. 62/548,343, filed on Aug. 21, 2017.

(51) Int. Cl.
*F15D 1/00* (2006.01)
*H04R 1/28* (2006.01)

(52) U.S. Cl.
CPC ..... *F15D 1/0035* (2013.01); *H04R 1/288* (2013.01); *H04R 1/2811* (2013.01)

(58) Field of Classification Search
CPC ..... H04R 1/2811; H04R 1/288; F15D 1/0035
USPC ..... 181/167
See application file for complete search history.

(56) References Cited

U.S. PATENT DOCUMENTS 3,768,590 A * 10/1973 Yocum ..... G10K 13/00 181/167
5,109,422 A * 4/1992 Furukawa ..... H04R 1/023 181/160
7,070,850 B2 * 7/2006 Dietz ..... B32B 27/08 428/172
2005/0094837 A1 * 5/2005 Parker ..... H04R 1/02 381/355
2011/0186685 A1 * 8/2011 Tsotsis ..... B64C 21/10 244/130
2011/0262705 A1 * 10/2011 Gupta ..... B64C 21/10 428/156
2013/0146217 A1 * 6/2013 Kray ..... F15D 1/003 156/210
2016/0325818 A1 * 11/2016 Williams ..... B29C 59/022
2018/0167710 A1 * 6/2018 Silver ..... H04R 1/1008

* cited by examiner

*Primary Examiner* — Forrest M Phillips
(74) *Attorney, Agent, or Firm* — Fish IP Law, LLP

(57) ABSTRACT

Wavy riblets are disposed at one or more auditorily important acoustical boundary layers of a sound producing device. Wavy riblets can be deployed directly onto the surface of the device, and/or onto a film or other carrier that is then positioned in or on the device. Wavy riblets can be advantageously deployed in sets, in a herringbone pattern, and sets of smaller riblets can be disposed between sets of larger riblets. Wavy riblets can also be superimposed onto other wavy or non-wavy riblets. Contemplated sound producing devices include speakers, musical instruments, fan blades and ducts.

20 Claims, 8 Drawing Sheets

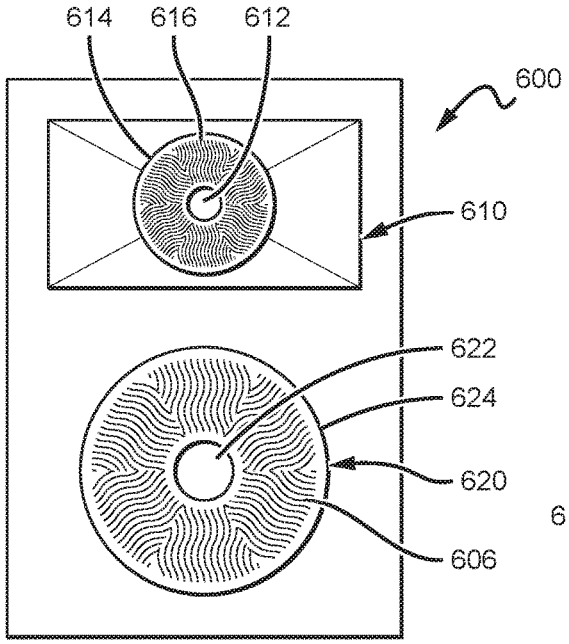
FIG. 6
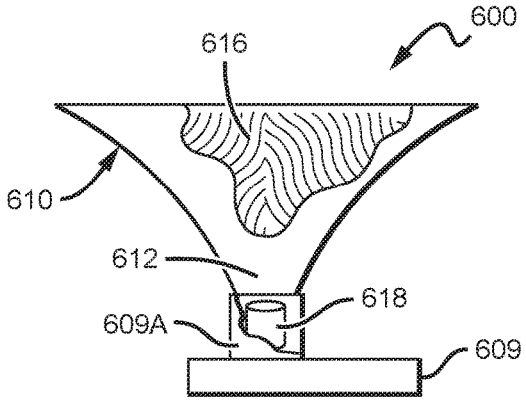
FIG. 7
FIG. 8A
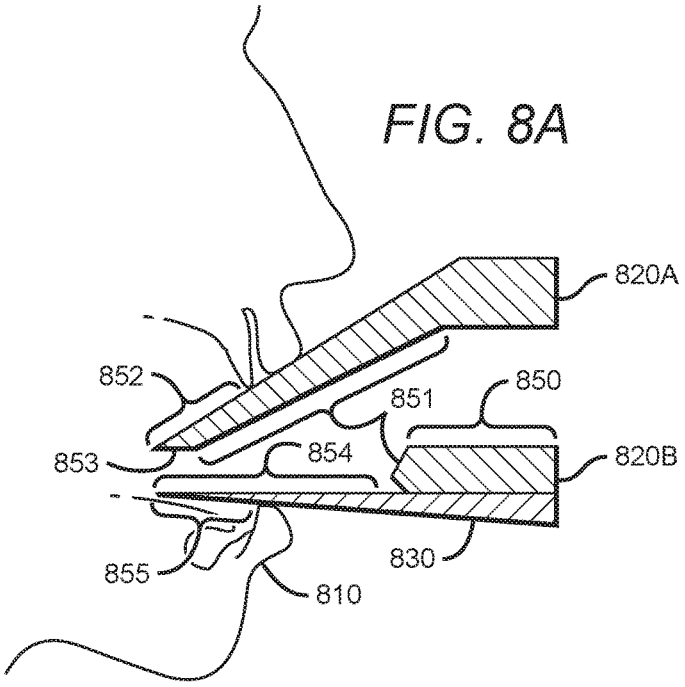

METHODS AND APPARATUS FOR IMPROVING SOUND WITHIN AN ACOUSTICAL BOUNDARY LAYER

This application claims priority to U.S. provisional application Ser. No. 62/548,343 filed Aug. 21, 2017, which is incorporated herein in its entirety.

FIELD OF THE INVENTION

The field of the invention is fluid dynamics, and especially acoustic fluid dynamics.

BACKGROUND

The background description includes information that may be useful in understanding the present invention. It is not an admission that any of the information provided herein is prior art or relevant to the presently claimed invention, or that any publication specifically or implicitly referenced is prior art.

In any device in which air or other fluid moves across a surface, there is turbulence within the boundary layer between the mean flow and the surface, especially when the airflow in a passageway becomes faster in speed. In some instances that turbulence is desirable, and in other instances that turbulence can be problematic.

In speaker port ducts, microphones, and musical instruments passageways, turbulence and associated vortex shedding is a cause of acoustical noise and unwanted distortions. The problem has been addressed to some extent by using larger diameter port ducts, this will help with limiting acoustical compression, but this will make the overall speaker box size larger. See e.g., *Maximizing Performance from Loudspeaker Ports*, Salvatti, Alex; Devantier, Allan; Button, Douglas J., JAES Volume 50 Issue 1/2 pp. 19-45; February 2002. But larger port bores do not eliminate turbulence within the boundary layer. The problem has also been addressed to some extent by using structures on the surface of the flaring. See for example, U.S. Pat. No. 6,019,188 to Nevill. But none of those technologies adequately addresses the root problem of distortions that a port duct has on a complex sound wave moving through or over a turbulent boundary layer.

Salvatti and Nevill, and all publications referenced herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Thus, there is still a need for systems and methods that reduce distortion and noise/or improve other sound qualities of speakers, musical instruments, microphones and other devices having an auditorily important acoustical boundary layer.

SUMMARY OF THE INVENTION

The inventive subject matter provides apparatus, systems and methods in which wavy riblets are disposed at auditorily important acoustical boundary layer of a sound producing device.

As the term is used herein, riblets are not mere scratches imparted incidentally during a manufacturing or growth process. Riblets are small grooves or protrusions, intentionally deployed onto a surface for a desired effect. It is particularly contemplated in this application that individuals and companies will deploy riblets in or on sound producing devices as a result of having received information that application of wavy riblets can improve the sound performance of such devices. In the case of a musical instrument, for example, wavy riblets may well be utilized to reduce distortion, and/or to improve transmission of desired frequencies. In the case of a fan blade, or an air conditioning duct, wavy riblets may well be utilized to merely reduce the sound of the air flow.

And whether or not those deploying wavy riblets understand the underlying physics, it appears that all of these effects are achieved by reducing turbulence and associated vortex shedding of air flowing over the boundary layer of the surface where the wavy riblets are deployed.

As used herein, the term "sound producing device" includes sound redirecting devices. Thus, in a speaker housed in a speaker housing, the driver, the diaphragm, the sound port duct, and the wooden box or other type of enclosures, are each considered to be a sound producing device. Similarly, in a guitar, violin, or cello type of instrument, the sound box (body) is considered to be a sound producing device, even though the original source of the sounds is vibration of the strings.

Among other inventive concepts herein, the current Applicant has discovered that wavy riblets are especially useful in altering acoustical properties of a sound producing device. Wavy riblets can be deployed directly onto a surface of a device, for example, by etching wavy riblets into the bell of a musical instrument, or the port duct of a speaker housing. Wavy riblets can additionally or alternatively be engraved mechanically, optically, chemically etched, or molded onto a surface of a film or other carrier, and then the carrier can be deployed onto or into an air flow passageway of the sound producing device.

Wavy riblet-enhanced surfaces can have any degree of rigidity or non-rigidity, and can be smooth or have any sort of preexisting manufactured or native pattern. All suitable methods of deploying wavy riblets on a surface are contemplated, including especially mechanically, optically or chemically etching the surface, and applying molded wavy riblets to the surface.

Wavy riblets preferably have a substantially "U" shaped primary grooves, i.e., with sides leading to a curved bottom. Less preferred riblets could have a "V", rectangular, or other cross-sectional shape. Different wavy riblets on a surface can have different shapes. Wavy riblets can also have secondary grooves, which can advantageously be disposed longitudinally within the primary grooves.

Wavy riblets can be optimized for different purposes by having different orientations and dimensions, and by proximity to other riblets. In general it is thought that shallower and narrower riblet grooves are better for handling higher frequency sound waves, while deeper and wider riblet grooves are thought to be better for handling lower frequencies. A combination of different sizes of wavy riblets is thought to improve performance over a wide range of frequencies and Reynolds numbers. For frequencies typically used in music, 20 Hz to 15 KHz, wavy riblets are thought to be optimized where they have wavelengths of between 3 mm and 100 mm (more preferably 5-60 mm), amplitudes between 1 mm and 10 mm (more preferably 2-5 mm), lengths between 1 wavelength (3 mm) and 40 cm or more, as long as is needed for the device application size, and riblet groove depths between 0.1 μm and 300 μm, and riblet groove widths between 0.1 μm and 300 μm.

The current Applicant has also discovered that it is advantageous for wavy riblets to be arranged in one or more herringbone patterns, which might or might not converge at the "spine" of the herringbone(s). The "arms" of a herringbone pattern might or might not be symmetrical, and different herringbone patterns could form different angles. As used in this application, a pattern must have at least three pairs of left and right angled wavy riblet groups, in whatever angulations, for the pattern to be considered a herringbone pattern. FIG. 1, for example, shows three pairs of left and right wavy riblet groups, 110H-110I, 110J-110K, and 110L-110M. Implementation of a herringbone pattern on a surface is thought to improve the fluid dynamics of the acoustic boundary layer on the surface.

The current Applicant has still further discovered that frequency responsiveness can be optimized for various frequency bands using sets of smaller riblets disposed between sets of larger riblets. Further enhancements can be achieved by superimposing other riblets over the shorter wavelength "tonal" wavy riblets.

Where a wavy riblet-enhanced film is used, an adhesive can advantageously be included on one side of a film to facilitate attachment of the film to the device, or to itself. Wavy riblet-enhanced films are preferably between 25 μm and 750 μm thick. Where films are to be rolled, thicker films are at least in part limited by the flexibility of the films, and corresponding internal stress. Contemplated film materials include polypropylene, polycarbonate, polycarbonate with any pre-surface texture, hard coated or abrasion resistant or UV grades (PC), PDMS (polydimethylsiloxane), PET, Polytetrafluoroethylene (PTFE), or other plastics, aluminum, stainless steel or other metals, wood veneers, glass, silicone or other rubbers, ceramics, etc. It is contemplated to have a pattern on one side of a film, the same pattern on opposite sides of a film, or different patterns on opposite sides of a film. for example, one side could have an optically flat surface and the other side could have a five μm texture.

Wavy riblets can be advantageously disposed in or on any device in which the effects of air moving across a surface are relevant to an auditory experience. For example, technologies disclosed herein can be advantageously utilized in or on a vast array of auditory devices, including housings of electroacoustic transducers, including for example speakers, speaker enclosures, microphones, driver cones, vent ports, headphones, earbuds, hearing aids, etc. These technologies are also thought to be useful in improving sound performance of wind or brass instruments. For example, contemplated wavy riblets can be deployed in a passageway about a mouthpiece, a passageway about the reed, a tone hole, a bore of a musical instrument, or a bell or horn of a clarinet, flute, French horn, trumpet, trombone, etc. These technologies can also be used within a resonating chamber of a box type instrument such as a guitar, piano, violin or cello. Still further, these technologies can be used in a piano or musical instrument that does not have a specific air tube or resonant chamber. In a piano, for example, wavy riblets can be deployed on the underside of the piano lid. These technologies can also be utilized on the wall of a listening room, concert venue, or other structure of a building, preferably using a wavy riblet-enhanced film.

Wavy riblets can be deployed on any suitable region of a film or other surface. For example, wavy riblets can be placed onto the surface of something as small as a postage stamp (or even smaller), which is then simply glued onto the port duct or baffle of a speaker enclosure, on a inside wall of a speaker enclosure, on the horn or bell of a wind instrument, inside the resonating chamber or side wall of an acoustic string or other musical instrument, or on a sound collecting or directing portion of a microphone.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWING

FIG. 6 is a front view of a loudspeaker with a rectangular horn driver and a cone driver.

FIG. 7 is a vertical cutaway of the rectangular shaped wave guide of FIG. 6.

FIG. 8A is vertical cross-section of a clarinet or saxophone, or similar type of mouthpiece as the instrument is being played by a person.

DETAILED DESCRIPTION

The following description includes information that may be useful in understanding the present invention. It is not an admission that any of the information provided herein is prior art or relevant to the presently claimed invention, or that any publication specifically or implicitly referenced is prior art.

Although each described embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously. As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein, and all ranges set forth herein should be interpreted as being inclusive of their endpoints.

All methods described herein can be performed in any suitable order unless otherwise indicated herein, or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

One should appreciate that the disclosed techniques provide many advantageous technical effects, including reduction of distortion and noise/or improvement of other sound qualities, by reducing, turbulence and associated vortex shedding of air flowing across an acoustical boundary layer.

Figure 1:
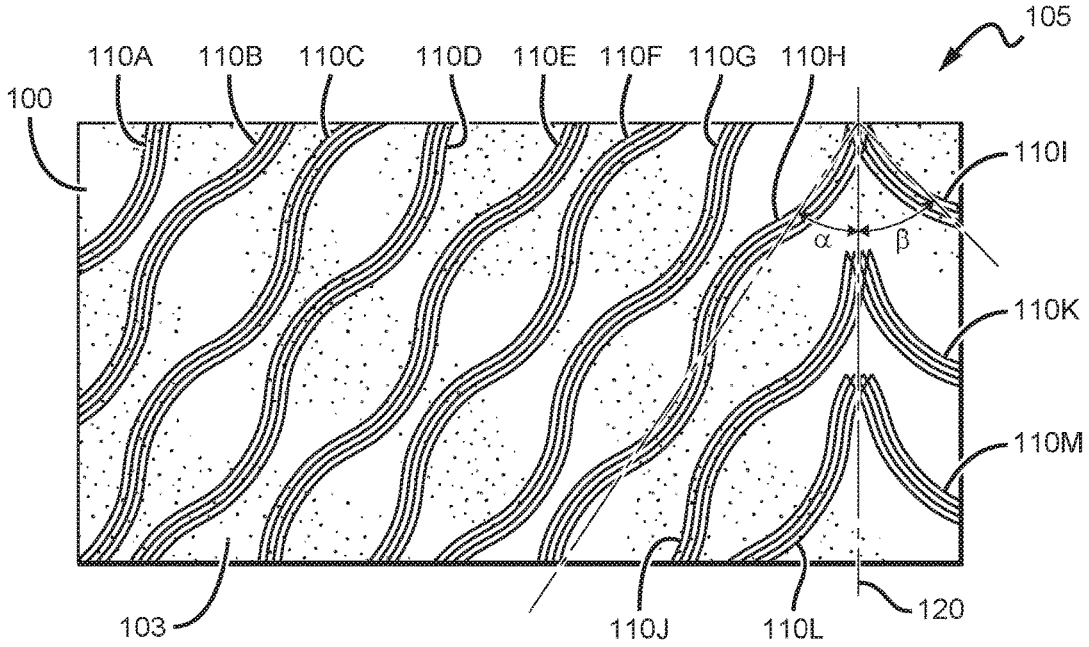
FIG. 1 is a plan view of a first set of wavy riblets, arranged in groups in a herringbone orientation on a surface.

FIG. 1 generally depicts a surface 100, whether a film or otherwise, having a set of several groups 110A-110M of wavy riblets arranged in a herringbone pattern 105. Wavy riblets 110H and 110I form part of the left and right sides of the herringbone 105, which has a "spine" 120. Wavy riblets 110J and 110K form additional left and right sides of the herringbone, as do wavy riblets 110L and 110M. As implemented in a port duct of a speaker housing, musical instrument passageways, or other device, the spine is preferably oriented parallel to the airflow.

In this particular instance, the left and right sides of the herringbone 105 are non-symmetrical. Also, in this particular instance, left and right sides of the herringbone 105 cross over one another approximately at the spine 120. In other contemplated embodiments the left and right sides of the herringbone might or might not be symmetrical, and might or might not touch at all. In still other embodiments, it is contemplated to use only one side (left or right) of what would otherwise be a herringbone arrangement.

Wavy riblet group 110G is oriented at an angle $\alpha$ of between 25° and 35° with respect to the spine, and wavy riblet Group 110I is oriented at an angle $\theta$ of between about 20° and 35° with respect to the spine. It considered desirable, but not necessary, for the left and right groups of wavy riblets be oriented at different angles with respect to the spine. Preferred angles are between 15° and 45°.

Wavy riblets within a group are preferably spaced apart by 0.1 μm and 200 μm. Wavy riblet groupings are preferably spaced apart by 0.5 mm and 10 mm or even up to 25 mm or more.

Cross-sections of the riblets can be "U" shaped, triangular, rectangular, or any other suitable shapes. Different wavy riblet "grooves" on a given surface can have different shapes.

Wavy riblets are preferably between about 0.1 μm and 300 μm deep. Shallower wavy riblets are thought to be more advantageous where relatively higher frequencies are considered more important, and deeper wavy riblets are thought to be more advantageous where relatively lower frequencies are considered more important. Having wavy riblets with different depths on a given surface, both within and between groupings, is thought to be beneficial because doing so will aid in reducing boundary layer turbulence within a wide range of Reynolds numbers.

Wavy riblets can have any suitable lengths, and as with the depths, it is desirable to use riblets having differing lengths. What seems to be more important is that riblets are wavy, having what appear to be "wavelengths". Preferred wavelengths are between 3 mm and 100 mm, more preferably between 5 mm and 75 mm. Here again it is preferred that different groups of wavy riblets have different wavelengths.

FIG. 1 also depicts an optional manufactured pattern (texture) 103 in the surface prior to the surface 100 being engraved with the wavy riblets 110A-110M.

Figure 2:
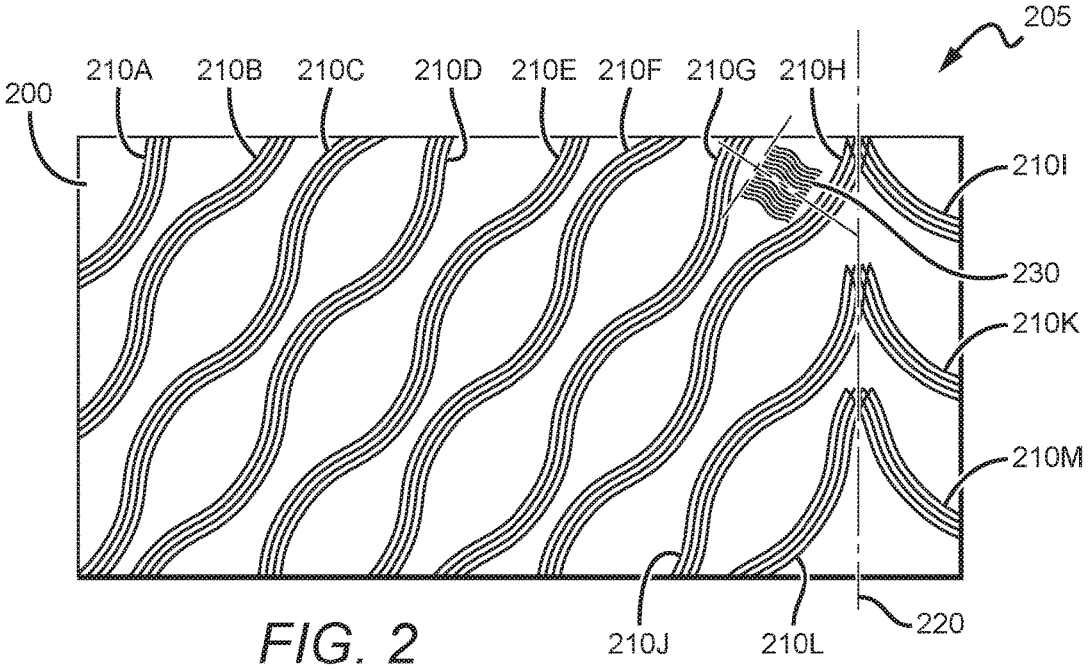
FIG. 2 is a plan view of second set of "tonal" wavy riblets disposed between two groups of wavy riblets of FIG. 1.

FIG. 2 shows a distortion reducing surface 200 having a first set of several groups 210A-210M of wavy riblets arranged in a herringbone pattern 205. Wavy riblets 210H and 210I form part of the left and right sides of the herringbone 205, which has a "spine" 220. In this view, the optional manufactured pattern (texture) is not shown.

In this embodiment there is a second set 230 of wavy riblets situated between group 210G and group 210H of wavy riblets. The wavy riblets of the second set 230 are referred to herein as "tonal" riblets, because they can be customized to alter performance for selected ranges of frequencies. In preferred embodiments, the second set of wavy riblets 230 are generally deeper and wider than wavy riblets of the first sets of riblets 210A-210M, and are angled between 20° and 70° with respect to the spine. There can be additional "tonal" riblets (not shown) elsewhere on the surface 200, as for example between riblet groups 210F and 210G, between wavy riblet groups 210H and 210J, and between 210I and 210K.

As shown in FIG. 2, the second set 230 of wavy riblets (the smaller "tonal" riblets) on the left side of herringbone 205 are substantially out of parallel with neighboring first sets groups 210G, 210H of wavy riblets, and the spine 220. In this particular instance, the second set 230 of wavy riblets is oriented at an angle $\gamma$ between 50° and 70°. Surprisingly, this angle affects performance, with better performance generally experienced between 55° and 65°. Considered from another perspective, it is preferred that the second set 230 of wavy riblets is angled between 50° and 70° with respect to the spine 220.

Groups of second sets of wavy riblets are preferably spaced apart by between 50 μm and 5 mm, and in any event spaced apart by distances less than spacings of groups of first sets of wavy riblets.

Other "second sets" of tonal riblets could additionally or alternatively be located on either or both sides of the spine 220.

The smaller "tonal" riblets can be similar to larger riblets width, shape, depth and spacing, except that they tend to be shorter, and have smaller "wavelengths". Although FIG. 2 shows only a single set of "tonal" riblets 230, a riblet-enhanced surface can have numerous sets of "tonal" riblets, perhaps or 10 more. Surprisingly, a single tonal engraving can actually be disadvantageous to the transmitted sound, producing harshness to especially higher frequency sounds.

Figure 3:
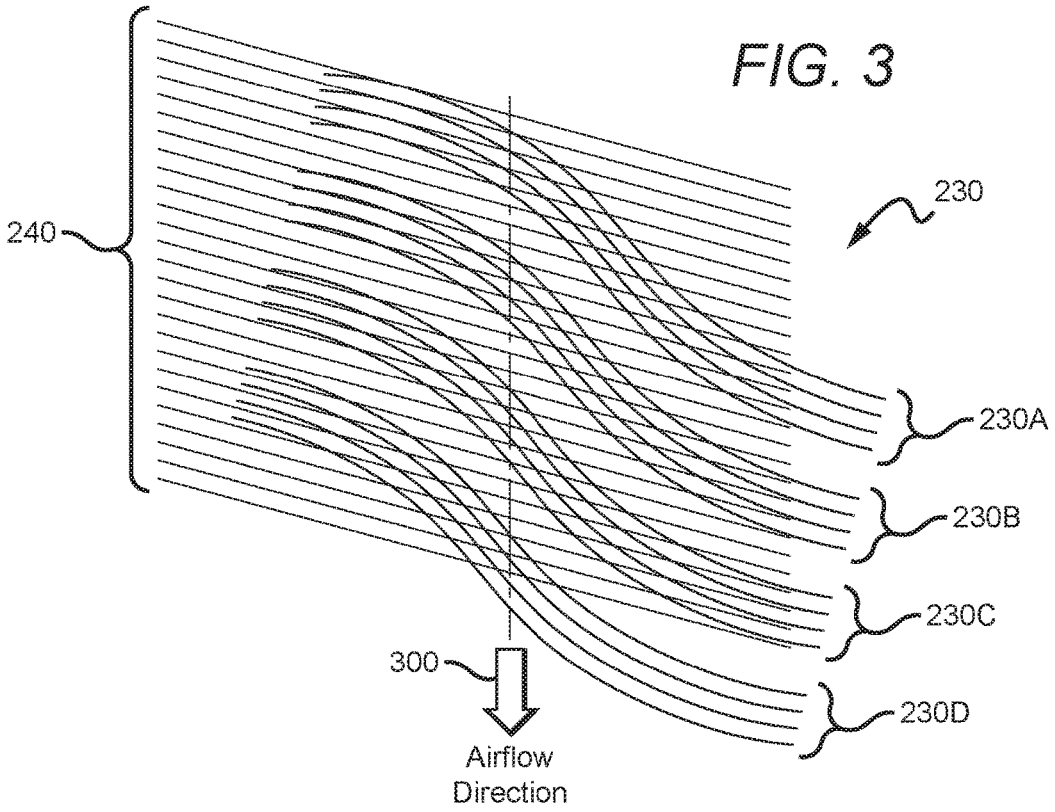
FIG. 3 is an enlarged version of the second set of wavy riblets of FIG. 2.

FIG. 3 shows an enlarged version of the second set of wavy riblets 230 (FIG. 2), arranged in four groupings 230A-230D. Superimposed on the second set of wavy riblets 230 is a third set of riblets 240, which might or might not be wavy, and might or might not generally track the waviness of the second set of wavy riblets 230. Third set of riblets 240 can be disposed in any desired angulation with respect to second set of wavy riblets 230. In preferred embodiments, the third set of wavy riblets 240 are generally shallower and narrower than riblets of the second set of riblets 230. Also depicted on FIG. 3 is a preferred airflow direction 300. The second and third sets of riblets can be used independently of any first set of wavy riblets.

Any of the various arrangements of riblets depicted in, and described with respect to, FIGS. 1-3, can be used by themselves, or in any combination, in any of the applications of the any of the other Figures.

Figure 4A:
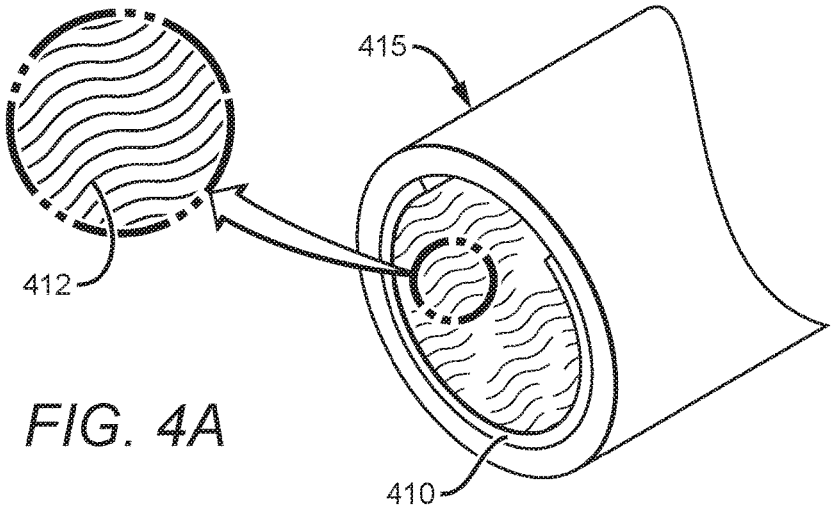
FIG. 4A is a cutaway section of a duct into which has been positioned a non-overlapping film having a first set of engraved wavy riblets.

FIG. 4A shows a film 410 having engraved wavy riblets 412 disposed in a duct 415. This duct 415 should be interpreted broadly to include any tube carrying sound waves, including for example, a loudspeaker port, a musical instrument passageway, or an HVAC duct. In this instance the film 410 does not overlap itself to form a cylinder. The wavy riblets in FIG. 4A should be interpreted to include herringbone pattern(s) of wavy riblets, non-herringbone pattern(s) of wavy riblets, or any other pattern(s) of wavy riblets, oriented in any direction.

Figure 4B:
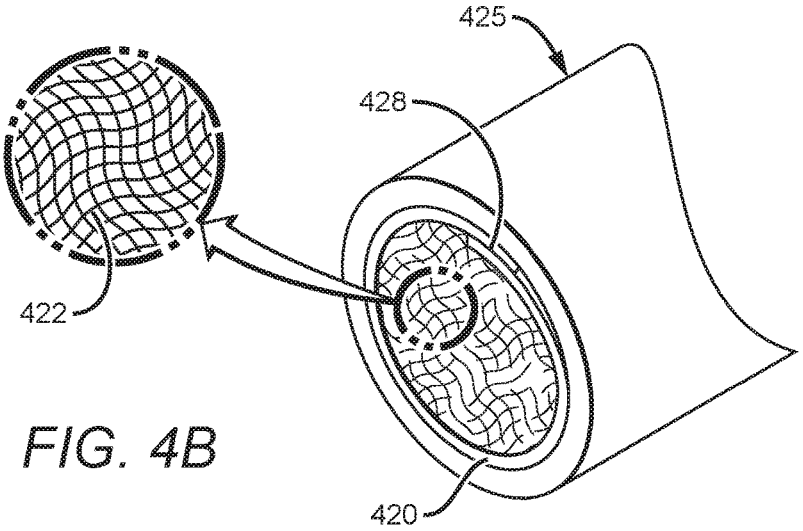
FIG. 4B is a cutaway section of a duct into which has been positioned an overlapping film having a first set of engraved wavy riblets.

FIG. 4B shows a different film 420 having engraved wavy riblets 422 disposed in a duct 425. This duct 425 should be interpreted broadly to include any tube carrying sound waves, including for example, a loudspeaker port, a musical instrument passageway, or an HVAC duct or vent register. In this instance the film 420 is rolled up to overlap itself (at 428) to form a cylinder.

Figure 4C:
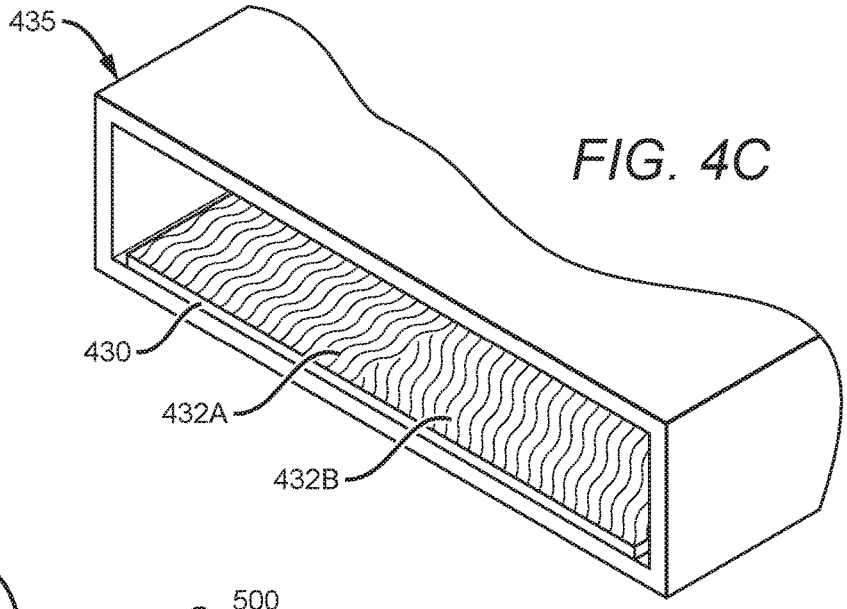
FIG. 4C is a cutaway section of a slotted or rectangular shaped duct into which has been positioned a film having first and second sets of engraved wavy riblets.

FIG. 4C shows a film 430 having engraved wavy riblets 432 disposed in a slotted or rectangular shaped duct 435. Duct 435 should be interpreted broadly to include any slotted or rectangular shaped duct carrying sound waves, which for example could be a loudspeaker port, a musical instrument passageway, or an HVAC duct. In this instance the film 430 is lying flat on a wall of the port duct. In other contemplated embodiments, the film could lie against one or more other walls of the duct, or could even be a sheet of wavy riblets folded to fit into the duct. In this instance there are two sets of wavy riblets 432A, 432B, having different angulations and different wavelengths.

The wavy riblets in each of FIGS. 4A, 4B and 4C should be interpreted to include herringbone pattern(s) of wavy riblets, non-herringbone pattern(s) of wavy riblets, or any other pattern(s) of wavy riblets, oriented in any direction.

Figure 5:
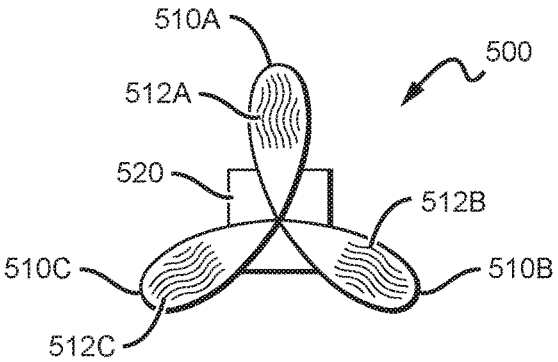
FIG. 5 is a schematic of a fan having wavy riblets on the blades.

FIG. 5 is a schematic of a fan having three blades 510A, 510B and 510C, and a motor housing 520 having a motor (not shown) that drives the blades. Other portions of the fan are omitted, and one should interpret the drawing broadly to represent any of a household fan, a computer cooling fan, an industrial or commercial fan, or even the fan of a jet engine. Each of the blades 510A, 510B and 510C has one or more sets of wavy riblets, 512A, 512B, 512C, respectively. In this figure, as in several others, the reader will appreciate that the wavy riblets are drawn out of proportion (much enlarged) to other features in the figures, to facilitate comprehension.

Wavy riblets can be deployed on any suitable portion of a surface. On a fan blade, for example, wavy riblets could advantageously be deployed on most or all of the wind directing surfaces. Wavy riblets could also advantageously be deployed on most or all of a wave guide or driver cone of a speaker, or a mouthpiece or bell of a wind instrument, or a sound box of a string or other musical instrument. On the other hand, it is contemplated that wavy riblets could be deployed on any smaller area of a surface, even down to a postage stamp or smaller area. For example, it has been experimentally determined that applying a postage stamp size area (20 mm×20 mm) of wavy riblets to the inside of a bell of a clarinet produces an audibly significant improvement in the sound. A similar result has been experimentally determined with respect to applying a much smaller sized film (3 mm×5 mm) with wavy riblets engraved and applied to a earbud style of headphones (not shown). A similar result has been successfully performed using a very small film inside a port duct of a speaker.

FIG. 6 generally depicts a speaker housing 600, a rectangular shaped wave guide 610 and a driver cone 620. The rectangular shaped wave guide 610 has a throat passageway 612 leading to a compression driver assembly, and a horn 614. There is a set of wavy riblets 616 located on the horn 614. The driver cone 620 has a dust cap 622, and a set of wavy riblets 606 located on the driver cone 620. Other wavy riblets (not shown) could be positioned on the back of the driver cone 620. Driver cone 620 juxtaposes rubberized cone suspension 624. As with substantially all other embodiments depicted herein, the riblets 606 can be engraved directly onto a surface, or molded directly onto a film, or applied to a film positioned on the surface.

FIG. 7 is a vertical cutaway of the rectangular shaped wave guide of FIG. 6, further showing a compression driver 609, wavy riblets 616 on waveguide and a rolled up film 618 having another set of wavy riblets disposed in a throat 609A of the compression driver 609. Film 618 can be satisfied by either non-overlapping film 410 or overlapping film 420, of FIGS. 4A and 4B, respectively.

FIG. 8A generally depicts a vertical cross-section of a single reed mouthpiece 800 of a clarinet or saxophone type of instrument (not shown), as played by a person 810. The mouthpiece 800 has a top portion 820A and a bottom portion 820B, and cooperates with a reed 830. This Figure should be interpreted as having wavy riblets in one or more of the possible locations within range designations 850, 851, 852, 853, 854, and 855. Component 850 indicates the bore of the mouthpiece 800.

Figure 8B:
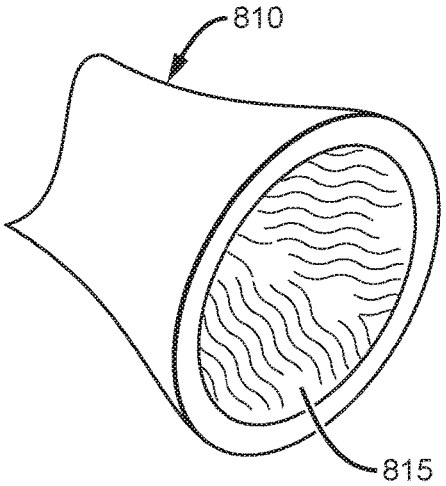
FIG. 8B is a perspective view of a bell portion of a wind musical instrument having a first set of wavy riblets in the bell.

FIG. 8B is a perspective view of a bell portion 810 of a wind musical instrument having a first set of wavy riblets 815 disposed directly in the bell 810. As elsewhere in this application, the riblets 815 are depicted much enlarged to facilitate comprehension by the reader.

Figure 9:
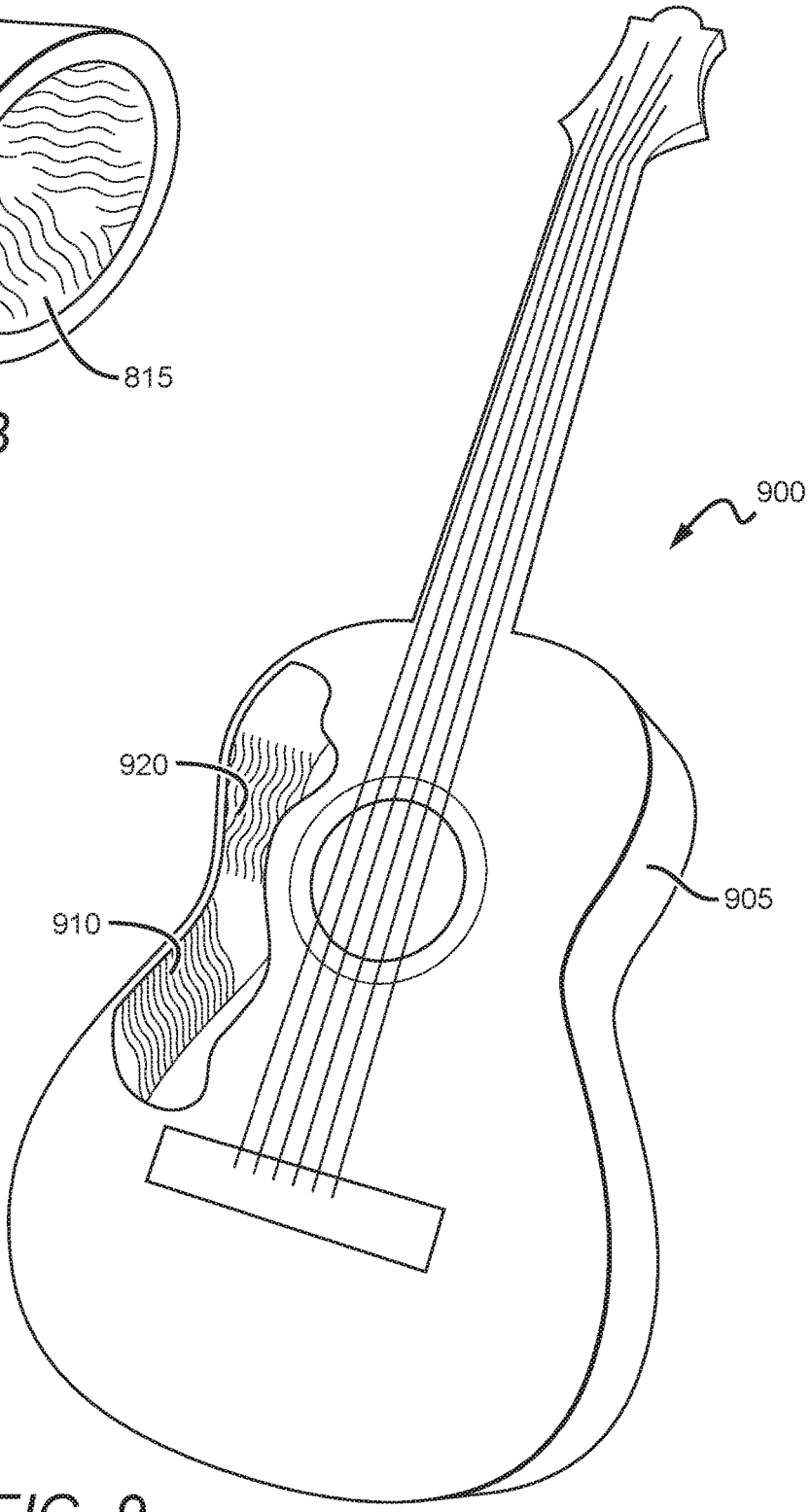
FIG. 9 is a partial cutout of a guitar, showing two possible positions of wavy riblets along an inside side wall of the guitar box.

FIG. 9 is a partial cutout of a guitar 900, showing two possible sets of wavy riblets 910, 920 along an inside side wall of the guitar box 905. Other locations are contemplated, including on the top inside and bottom inside walls of the box 905, but those locations are less preferred. All of the inside walls of the guitar box, as well as the walls of the sound hole, are considered herein to be surfaces of an air flow passageway, because it is contemplated that during the course of playing music, air travels along such surfaces in a manner that helps produce audibly detectable characteristics of the resulting sound.

Different sets of wavy riblets can have the same or different arrangements of wavy riblets. In this particular example, wavy riblets 910 are arranged differently from wavy riblets 920. As shown, wavy riblets are only along a relatively small portion of the inside wall of the guitar box 905, but it is also contemplated that wavy riblets could be placed on a larger or even smaller portion of the inside of the guitar box 905.

Figure 10:
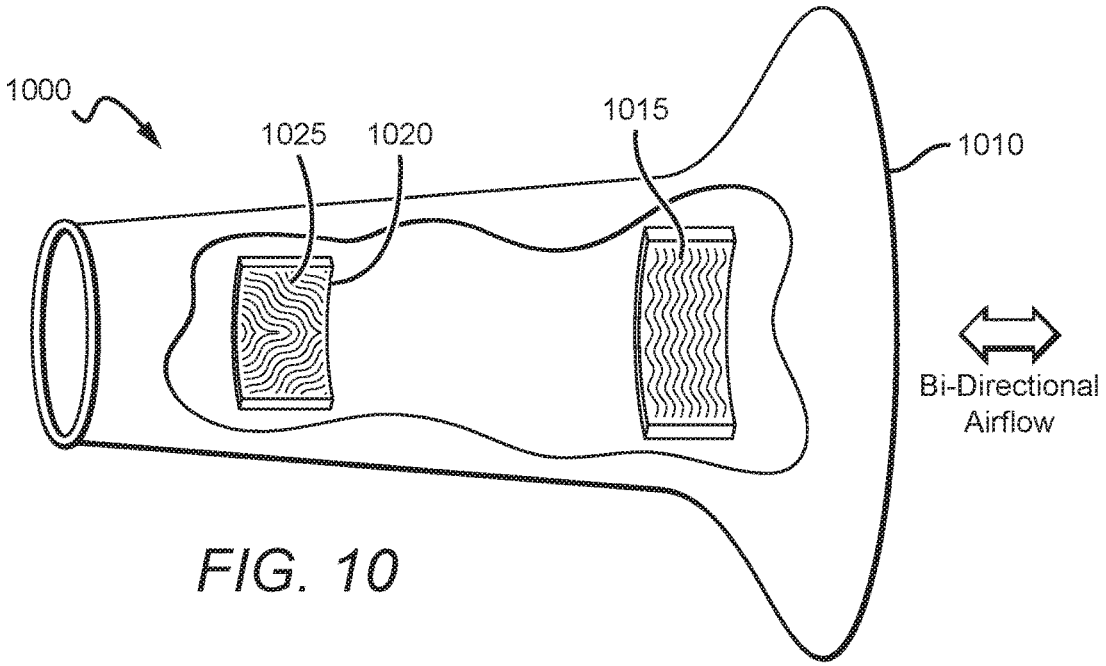
FIG. 10 is a cutaway view of a bell of a clarinet, oboe or other wind instrument, showing two different locations of for wavy riblets.

FIG. 10 is a cutaway view of a bell 1000 of a clarinet, oboe or other wind instrument, showing a flaring portion 1010, and two different locations for first and second sets of wavy riblets, 1015, 1025. Wavy riblets 1015, 1025 are preferably deployed on one or more films, e.g., film 1020, and as with films 410, 420, films within bell 1000 can go partly or fully around the inner wall of the bell 1000.

Figure 11A:
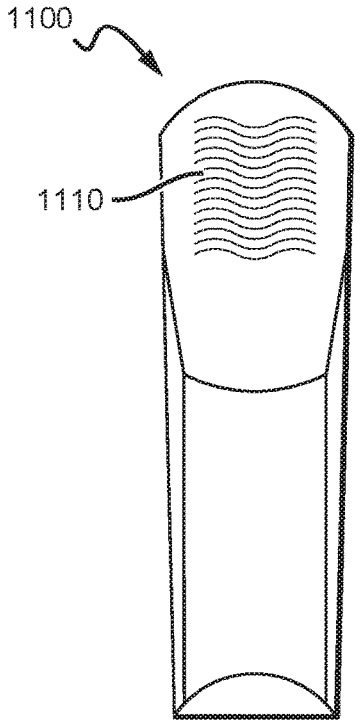
FIG. 11A is a top view of a single reed for a clarinet, saxophone or similar instrument.
Figure 11B:
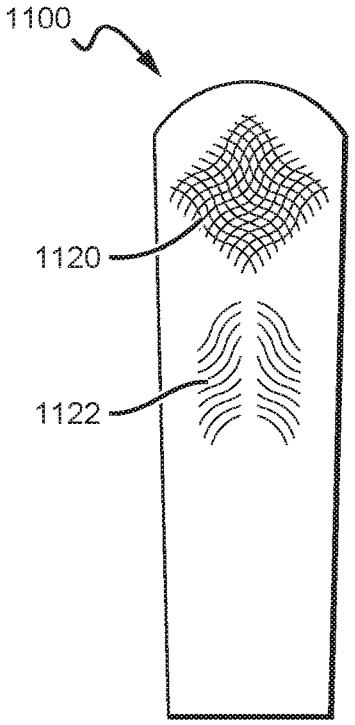
FIG. 11B is a bottom view of the single reed of FIG. 11A.

FIGS. 11A and 11B are top and bottom views, respectively, of a single reed 1100 for a clarinet, saxophone or similar instrument. A first set 1110 of wavy riblets engraved directly onto the top side of the reed 1100, and second and third sets 1120, 1122 of wavy riblets are engraved directly on the bottom side of the reed 1100.

Figure 12:
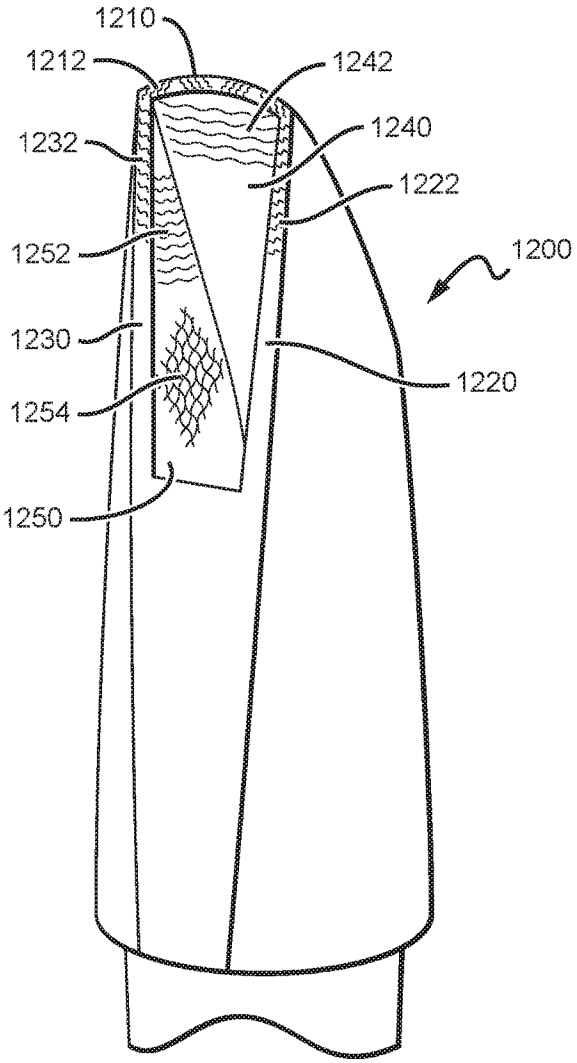
FIG. 12 is a perspective top view of single reed mouthpiece for a clarinet, saxophone or similar instrument.

FIG. 12 is a perspective top view of single reed mouthpiece 1200 for a clarinet, saxophone or similar instrument, and depicts numerous contemplated locations to place wavy riblets. Tip rail 1210 has wavy riblets 1212 engraved directly into the mouthpiece. The right side rail 1220 has wavy riblets 1222 engraved directly onto the right side rail, in a region where the flat part of the mouthpiece curves away from the reed. The left side rail 1230 has wavy riblets 1232 engraved directly onto the left side rail, in a region where the flat part of the mouthpiece curves away from the reed. Yet another group of wavy riblets 1242 are disposed on the baffle 1240. Additional groups of wavy riblets 1252, 1254 are disposed on side wall 1250.

Figure 13A:
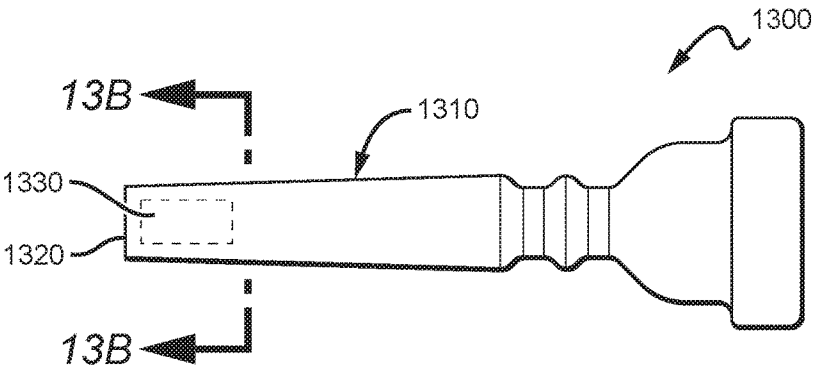
FIG. 13A is side view of a mouthpiece for a trumpet, trombone or other brass instrument.

FIG. 13A is side view of a mouthpiece 1300 for a trumpet, trombone or other brass instrument, having a throat region 1310 that leads to air passageway 1320. A rolled up film with wavy riblets engraved 1330.

Figure 13B:
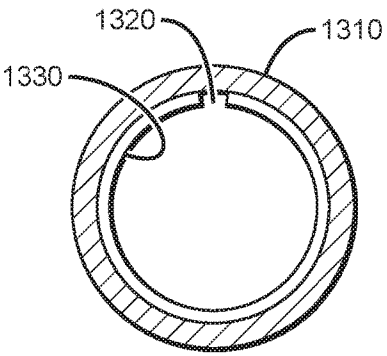
FIG. 13B is a view of the mouthpiece of FIG. 13A, cut along B-B'.

FIG. 13B is a view of the mouthpiece of FIG. 13A, cut along B-B'. A film 1330 is rolled up inside the throat region 1310. It should be appreciated that film 1330 can be positioned at any location inside the throat region 1310.

Figure 14A:
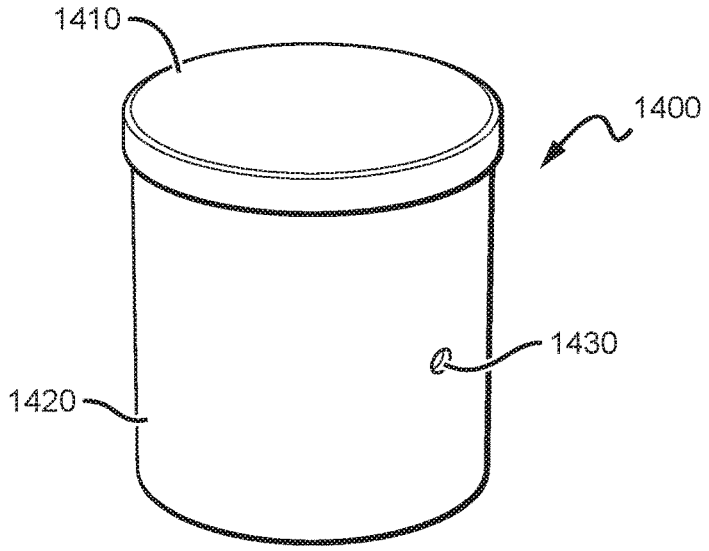
FIG. 14A is a perspective view of the outside of a drum.
Figure 14B:
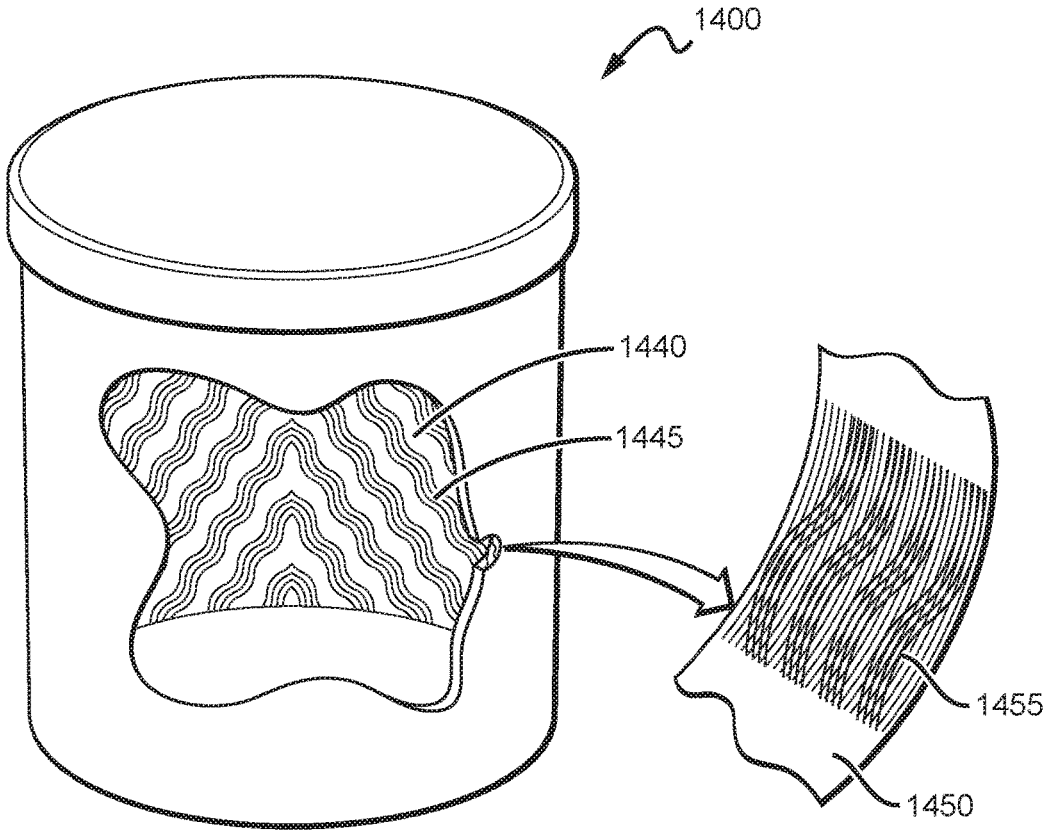
FIG. 14B is a cutaway showing a portion of the inside of a drum and an optional port duct.

FIG. 14A is a perspective view of the outside of a drum 1400 having a top skin 1410 and a shell 1420. There is an optional bottom skin (not shown), and an optional port duct 1430. FIG. 14B is a cutaway showing a portion of the inside of the drum 1400 of FIG. 14A. Inside the drum 1400 is a film 1440 upon which are engraved wavy riblets 1445. The barrel region of the drum in which the riblets are disposed is considered herein to be an air flow passageway of the drum. Inside the port duct 1430 is another film 1450 with another set of engraved wavy riblets 1455.

The reader will appreciate that throughout the drawing figures, some of the wavy riblets are drawn in a herringbone pattern, and some are drawn without a clear herringbone pattern. Except for riblets described in the text as having specific sizes, shapes, or configurations, riblets should be viewed as having either herringbone or non-herringbone patterns.

The reader will also appreciate that each of the devices of FIGS. 4A, 4B, 5, 6, 7, 8A, 8B, 9, 10, 11A, 11B, 12, 13A, 13B, 14A and 14B are considered herein to be sound producing devices.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context.

What is claimed is:

1. A method of removing distortion and improving transmission of desired frequencies within a sound producing device, the method comprising deploying a first set of wavy riblets within an air flow passageway of the device.

2. The method of claim 1, wherein the sound producing device comprises a musical instrument.

3. The method of claim 1, wherein the sound producing device comprises a speaker housing.

4. The method of claim 1, wherein the first set of wavy riblets is disposed in a herringbone pattern.

5. The method of claim 1, further comprising engraving the first set of wavy riblets directly onto a surface of the air flow passageway.

6. The method of claim 1, further comprising engraving the first set of wavy riblets onto a surface of a film, and placing the film at a portion of the air flow passageway.

7. The method of claim 6, wherein the film comprises a polymeric film.

8. The method of claim 1, further comprising engraving the first set of wavy riblets onto a surface, in which the surface has a manufactured pattern prior to being engraved with the first set of wavy riblets.

9. The method of claim 1, further comprising engraving the first set of wavy riblets onto a surface using at least one of mechanically, optically, and chemically etching the surface.

10. The method of claim 1, wherein each of at least 3 adjacent riblets of the first set of riblets has a substantially "U" shaped primary groove.

11. The method of claim 1, wherein each of at least 3 adjacent ones of the first set of riblets has a primary and a secondary groove, and the secondary grooves are disposed longitudinally along the primary grooves.

12. The method of claim 1, wherein at least 3 adjacent riblets of the first set of riblets independently have wavelengths of between 3 mm and 100 mm, amplitudes between 1 mm and 10 mm, lengths between 3 mm and 40 cm or more, and depths between 0.1 μm and 300 μm, and widths between 0.1 μm and 300 μm.

13. The method of claim 1, wherein the first set of wavy riblets is disposed in a herringbone pattern in which at least 3 pairs of the riblets are non-converging.

14. The method of claim 1, wherein the first set of wavy riblets is disposed in a herringbone pattern having a spine, and wherein at least 3 pairs of the riblets do not extend to the spine.

15. The method of claim 1, wherein the first set of riblets is separated into at least 3 separated, and substantially parallel, groupings.

16. The method of claim 1, further comprising deploying a second set of riblets within a non-engraved space between individual ones of the first set of riblets.

17. The method of claim 16, further comprising superimposing a third set of riblets over the second set of riblets.

18. The method of claim 1, wherein the sound producing device comprises a musical instrument, and the first set of wavy riblets is disposed within at least one of a tone hole of the musical instrument, a mouthpiece of the musical instrument, and a passageway about a reed of the musical instrument.

19. The method of claim 1, further comprising receiving information that application of riblets can improve sound performance of the sound producing device.

20. The method of claim 1, wherein the passageway comprises a port or duct of a speaker, or throat of a compression driver.

* * * * *